US009371119B2

(12) United States Patent
Malcom et al.

(10) Patent No.: US 9,371,119 B2
(45) Date of Patent: Jun. 21, 2016

(54) PERSONAL FLOTATION DEVICE HAVING SELECTIVELY INFLATABLE BLADDERS

(71) Applicants: Adam J. Malcom, Charlottesville, VA (US); Scott Kasen, Crozet, VA (US)

(72) Inventors: Adam J. Malcom, Charlottesville, VA (US); Scott Kasen, Crozet, VA (US)

( * ) Notice: Subject to any disclaimer, the term of this patent is extended or adjusted under 35 U.S.C. 154(b) by 0 days.

(21) Appl. No.: 14/380,524

(22) PCT Filed: Feb. 22, 2013

(86) PCT No.: PCT/US2013/027326

§ 371 (c)(1),
(2) Date: Aug. 22, 2014

(87) PCT Pub. No.: WO2013/126705

PCT Pub. Date: Aug. 29, 2013

(65) Prior Publication Data

US 2015/0011136 A1 Jan. 8, 2015

Related U.S. Application Data

(60) Provisional application No. 61/601,811, filed on Feb. 22, 2012.

(51) Int. Cl.

| | |
|---|---|
| ***B63C 9/08*** | (2006.01) |
| ***B63C 9/125*** | (2006.01) |
| ***B63C 9/18*** | (2006.01) |

(52) U.S. Cl.

CPC ..... *B63C 9/1255* (2013.01); *B63C 9/18* (2013.01)

(58) Field of Classification Search

CPC ..... B63C 9/1255; B63C 9/18

USPC ..... 441/108, 113

See application file for complete search history.

(56) References Cited

U.S. PATENT DOCUMENTS

| | | | | |
|---|---|---|---|---|
| 346,332 | A | 7/1886 | Vaughan | |
| 1,397,248 | A | 11/1921 | Frantz | |
| 2,313,151 | A | 3/1943 | Johnson | |
| 2,615,182 | A | 10/1952 | Podell | |
| 2,621,342 | A | 12/1952 | Boyle | |
| 3,130,424 | A | 4/1964 | Santangelo | |
| 3,452,374 | A | 7/1969 | Turner | |
| 4,626,221 | A | 12/1986 | Rocco | |
| 4,925,418 | A | 5/1990 | Mariotto nee Amiel | |
| 5,500,952 | A | 3/1996 | Keyes | |
| 5,549,495 | A * | 8/1996 | Burnworth | B63C 9/115 441/108 |

(Continued)

OTHER PUBLICATIONS

West Marine "Comfort Series Automatic Inflatable Life Vests", Model No. 8678963, dated May 2, 2009, www.westmarine.com.
West Marine "Comfort Series Automatic Inflatable Belt Pack", Model No. 9424938 dated May 2, 2009, www.westmarine.com.

*Primary Examiner* — Stephen Avila
(74) *Attorney, Agent, or Firm* — MacMillan, Sobanski & Todd, LLC

(57) ABSTRACT

An improved structure for a personal flotation device that is relatively comfortable to wear when not in use includes a primary bladder that is shaped to extend about a waist of a user. The personal flotation device also includes a secondary bladder that is in fluid communication with the primary bladder and is shaped to extend upwardly from the waist across a stomach of the user. Lastly, the personal flotation device includes a tertiary bladder that is in fluid communication with the secondary bladder and is shaped to is adapted to across the front of a chest of the user.

9 Claims, 4 Drawing Sheets

(56) References Cited

U.S. PATENT DOCUMENTS

| | | | | |
|---|---|---|---|---|
| 5,702,279 | A | 12/1997 | Brown | |
| 5,879,213 | A | 3/1999 | Williams, Jr. et al. | |
| 5,954,556 | A | 9/1999 | Powers | |
| 7,033,237 | B2 * | 4/2006 | Spagnuolo | A41D 7/003 441/108 |
| 7,854,347 | B2 | 12/2010 | Wang | |
| 2004/0033739 | A1 * | 2/2004 | Courtney | B63C 9/1055 441/88 |

* cited by examiner

PERSONAL FLOTATION DEVICE HAVING SELECTIVELY INFLATABLE BLADDERS

CROSS-REFERENCE TO RELATED APPLICATIONS

This application claims the benefit of U.S. Provisional Application No. 61/601,811 filed Feb. 22, 2012, the disclosure of which is incorporated herein by reference.

BACKGROUND OF THE INVENTION

This invention relates in general to personal flotation devices, commonly referred to as life vests or life jackets. In particular, this invention relates to an improved structure for such a personal flotation device that includes a belt-like structure containing a plurality of selectively inflatable bladders.

Personal flotation devices are well known in the art and are adapted to be worn by a user to keep the user afloat in a body of water to prevent drowning. To accomplish this, a typical personal flotation device supports or contains a material that is sufficiently buoyant in water as to keep the user afloat. A wide variety of personal flotation devices are known in the art for performing this general function.

Although known personal flotation devices have been successfully engineered to address the needs of users when floating in the water, it appears that little attention has been given to the design of such personal flotation devices when they are worn by users out of the water. On the contrary, many personal flotation devices are relatively uncomfortable to wear and significantly restrict the free movement of the arms and torso of the users wearing them. Consequently, many people simply do not wear their personal flotation devices when engaged in water activities until an emergency situation arises. Unfortunately, during such an emergency situation, it may be difficult to quickly locate and don the personal flotation device. Thus, it would be desirable to provide an improved structure for such a personal flotation device that is relatively comfortable to wear when not in use.

SUMMARY OF THE INVENTION

This invention relates to an improved structure for a personal flotation device that is relatively comfortable to wear when not in use. The personal flotation device includes a primary bladder that is shaped to extend about a waist of a user. The personal flotation device also includes a secondary bladder that is in fluid communication with the primary bladder and is shaped to extend upwardly from the waist across a stomach of the user. Lastly, the personal flotation device includes a tertiary bladder that is in fluid communication with the secondary bladder and is shaped to is adapted to across the front of a chest of the user.

Various aspects of this invention will become apparent to those skilled in the art from the following detailed description of the preferred embodiment, when read in light of the accompanying drawings.

DETAILED DESCRIPTION OF THE PREFERRED EMBODIMENT

Figure 1:
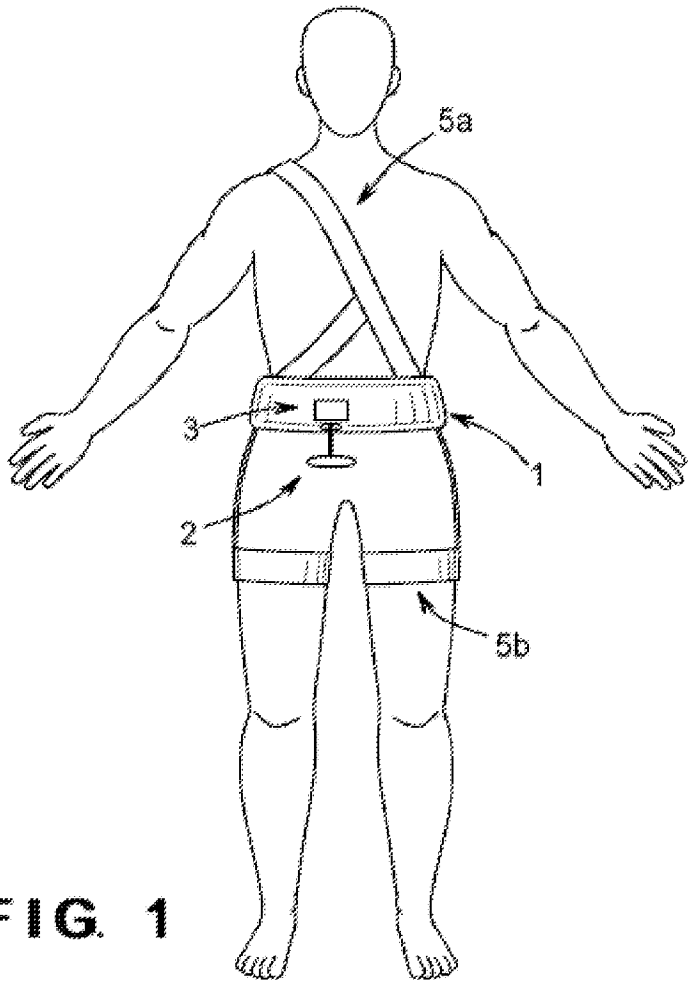
FIG. 1 is a front elevational view of a personal flotation device supported on a user in accordance with this invention, wherein the personal flotation device is shown in a deflated condition.
Figure 2:
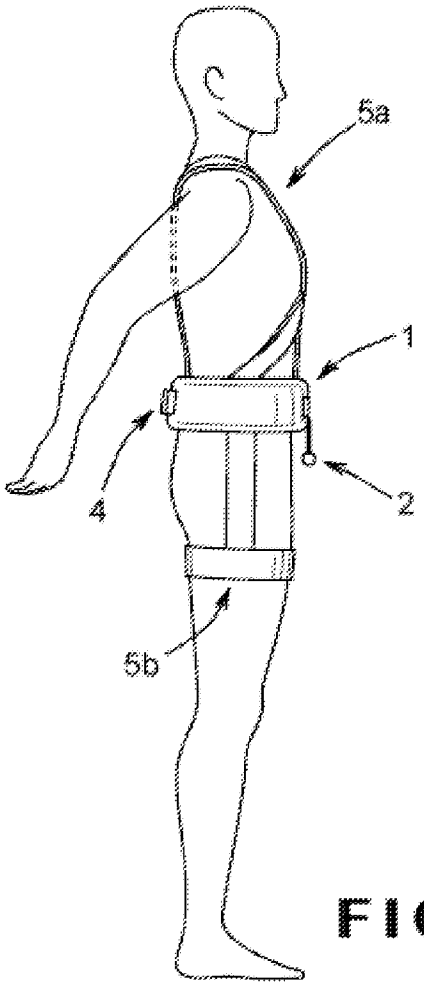
FIG. 2 is a side elevational view of the personal flotation device and user illustrated in FIG. 1.
Figure 4:
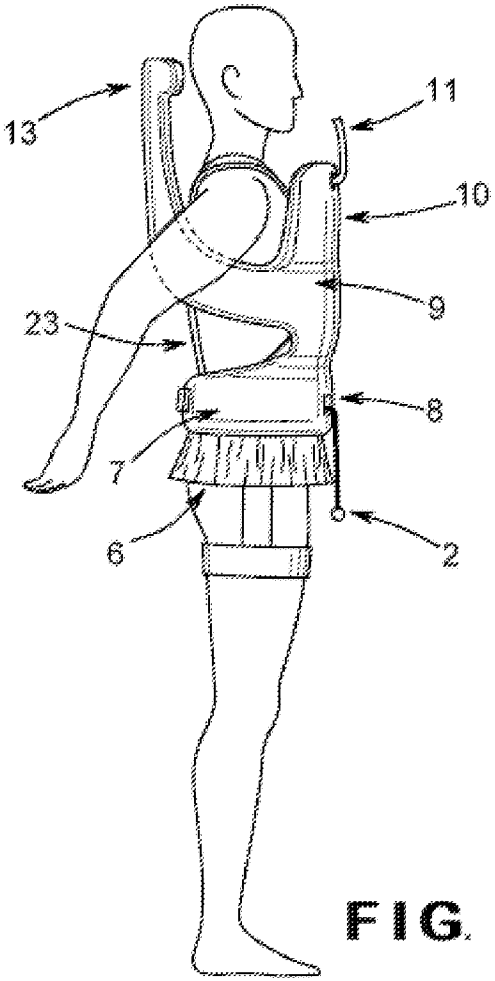
FIG. 4 is a side elevational view of the personal flotation device and user illustrated in FIG. 3.
Figure 3:
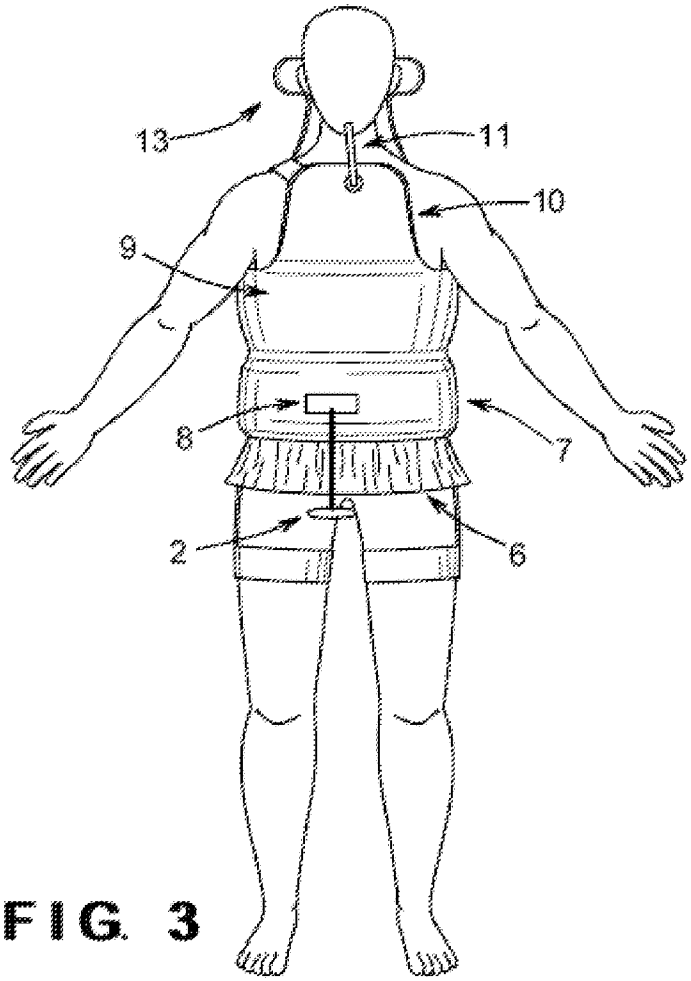
FIG. 3 is a front elevational view of the personal flotation device and user illustrated in FIGS. 1 and 2, wherein the personal flotation device is shown in an inflated condition.
Figure 5:
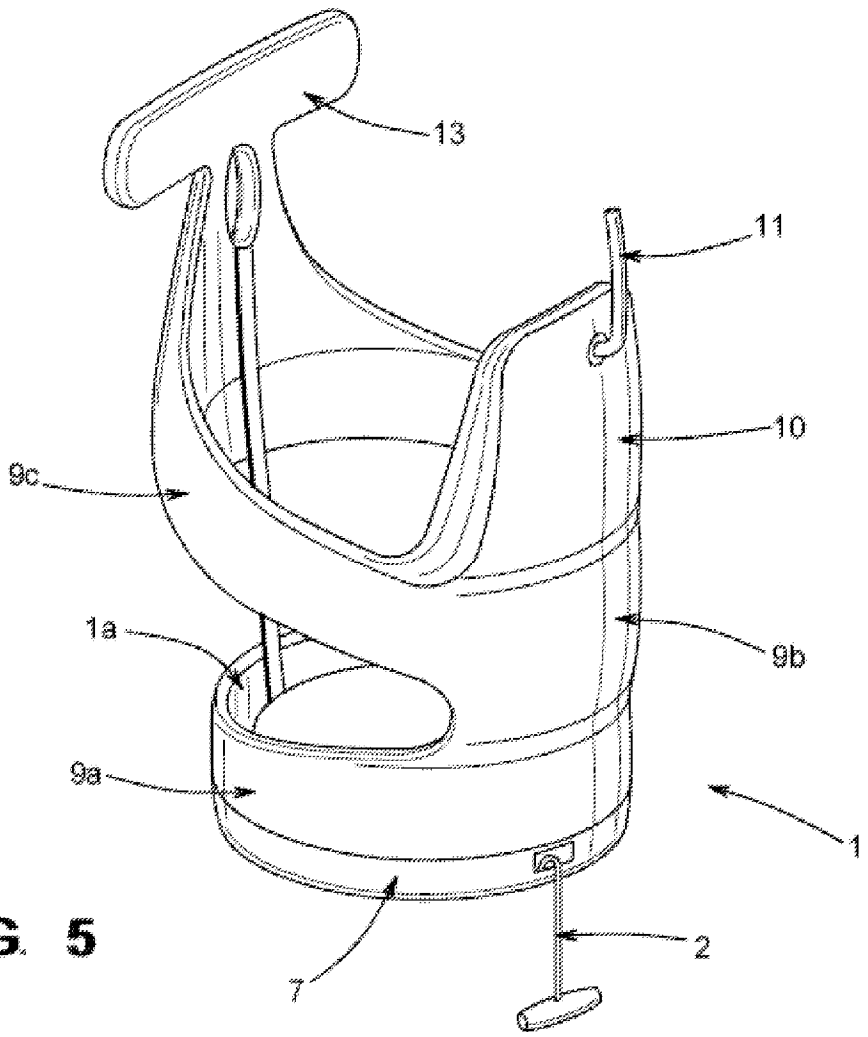
FIG. 5 is a perspective view of the personal flotation device illustrated in FIGS. 1 through 4 shown in an inflated condition.
Figure 6:
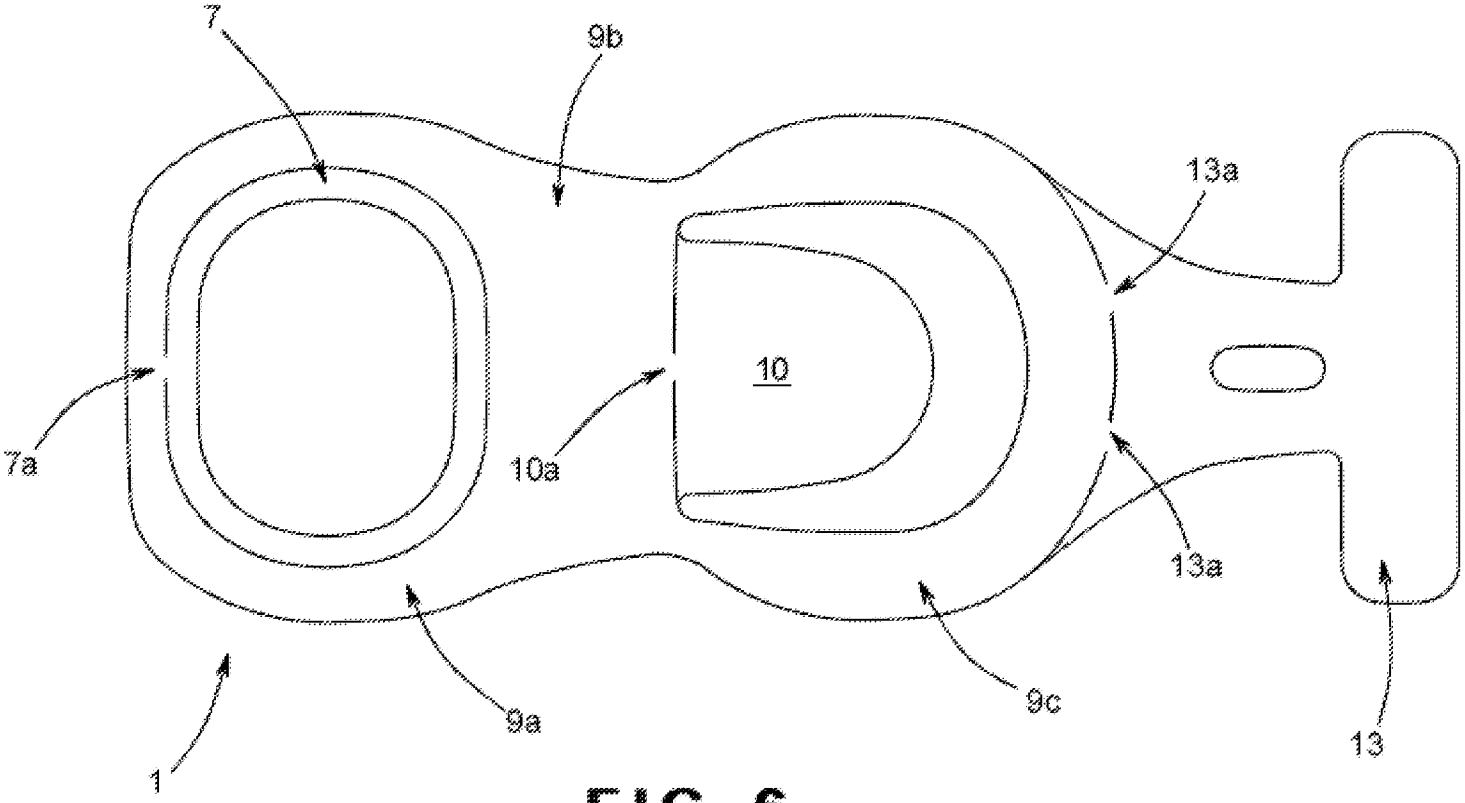
FIG. 6 is a top plan view of the personal flotation device illustrated in FIGS. 1 through 5 shown in a deflated condition.

Referring now to the drawings, there is illustrated in FIGS. 1 though 6 a personal flotation device (PFD) in accordance with this invention. FIGS. 1, 2, and 6 illustrate the PFD in a deflated condition, while FIGS. 3, 4, and 5 illustrate the PFD in an inflated condition. As will be explained in detail below, the PFD is adapted to be worn around the waist of the user as shown in FIGS. 1 and 2 when in a deflated condition. When so worn, the PFD is relatively comfortable and unobtrusive for the user to wear. However, in an emergency situation, the PFD can be quickly and easily actuated into an inflated condition as shown in FIGS. 3 and 4.

The PFD may be enclosed within a pouch 1 that is preferably formed from a flexible, fabric material, but can be formed from any desired material. This pouch 1 functions as a protective enclosure for the other components of the PFD when the PFD is not inflated. The pouch 1 may be annular in shape such that it can be supported on a waist of the user in the nature of a belt, as shown in FIGS. 1 through 4. If desired, the pouch 1 may be attached to an inner belt 1*a* (see FIG. 5) that also is adapted to extend around the waist of the user. The belt 1*a* can be formed from any desired material, but preferably is formed from a flexible, fabric material that is sufficiently strong to support the weight of the user on the PFD during use when inflated. Also, one or more buckles and/or tightening mechanisms 4 may be provided on or in connection with the belt 1*a* to facilitate the installation of the PDF on the user. In the illustrated embodiment, these buckles and/or tightening mechanisms 4 are located at the rear of the user, although such is not required. Additional body attachment structures, such as the torso straps and leg straps respectively shown at 5*a* and 5*b*, may optionally be provided.

The pouch 1 has one or more openings formed therethrough that allow an activation pull cord 2 to extend therethrough from the interior of the pouch 1 to the exterior thereof, where it can be easily accessed by the user. Within the pouch 1, one or more of gas cylinders, manual and/or automatic inflation devices, and armed and/or unarmed visual gauges 3 may be provided. The gas cylinders are conventional in the art and are adapted to contain a quantity of compressed air or other gas. When the activation pull cord 2 is pulled by the user, the gas cylinders are adapted to release such pressurized gas in the manner described below to actuate the PFD from its deflated condition to its inflated condition.

In FIGS. 1, 2, and 6, the PFD is shown in its deflated condition. In order to inflate the PFD, the user pulls on the activation pull cord 2. In response thereto, one or more of the gas cylinders and/or automatic inflation devices are actuated to release the pressurized gas therein through an inlet manifold into primary and secondary bladders 7 and 9, respectively, that are also contained within the pouch 1 when the PFD is in its deflated condition. As a result, the primary and secondary bladders 7 and 9 are expanded within the pouch 1. When the volume of either or both of the primary and secondary bladders 7 and 9 exceeds the available space within the pouch 1, the pouch 1 will split open along a seam 6 so as to allow the primary and secondary bladders 7 and 9 to expand outwardly therefrom, as shown in FIGS. 3, 4, and 5.

The primary bladder 7 may be provided with several chambers, all of which are preferably constructed from one continuous piece of fabric (although such is not required). The primary bladder 7 is the main attachment of integrated bladder system to the belt, which is then attached to the user. As shown in the drawings, the primary bladder 7 is adapted to extend about the waist of the user. To accomplish this, the primary bladder 7 may be formed in the shape of a complete annulus (in which case, the buckles 4 for the belt are not needed) or in the shape of a split annulus having first and second ends that are disposed adjacent to one another when the PFD is inflated. Regardless, it is desirable (but nor required) that the primary bladder 7 inflate first when the activation pull cord 2 is operated by the user.

As best shown in FIGS. 5 and 6, the illustrated secondary bladder 9 includes a lower portion 9*a*, an intermediate portion 9*b*, and an upper portion 9*c*. The lower portion 9*a* of the secondary bladder 9 is generally annular in shape and is adapted to extend about the waist of the user adjacent to the primary bladder 7. The intermediate portion 9*b* of the secondary bladder 9 is generally shaped as a flat panel and is adapted to extend upwardly from the waist across the stomach of the user. The upper portion 9*c* of the secondary bladder 9 is also generally annular in shape and is adapted to extend about the mid to upper torso portions of the user.

After the primary bladder 7 is sufficiently full, the compressed air passes through one or more restriction points 7*a* (see FIG. 6) into the secondary air bladder 9. The secondary bladder 9 is adapted to provide support under the arms of the user, as shown in FIGS. 3 and 4. The pneumatic pressure between the primary and secondary bladders 7 and 9 will cause such bladders 7 and 9 to "spring" open quickly, which may be important in an emergency situation. Pneumatic pressure develops a tensile condition of the fabric on outside edge, causing movement of the secondary bladder 9 until either the arms of the user impinge movement or fabric tensions equalize on both sides.

The PFD also includes a tertiary bladder 10 that is located at the front of the upper portion 9*c* of the PFD. The tertiary bladder 10 communicates with the upper portion 9*c* of the secondary bladder 9 through one or more restriction points 10*a* (see FIG. 6). The tertiary bladder 10 is adapted to provide support for the front of the chest of the user, as shown in FIGS. 3 and 4. If desired, an oral inflation tube 11 may be provided on the tertiary bladder 10 to allow the user to manually inflate the PFD if necessary.

The PFD further includes a head support bladder 13 that is located at the rear of the upper portion 9*c* of the secondary bladder 9 of the PFD. The head support bladder 13 communicates with the upper portion 9*c* of the secondary bladder 9 through one or more restriction points 13*a* (see FIG. 6). The head support bladder 13 is adapted to provide support for the rear of the head of the user, as shown in FIGS. 3 and 4. One or more bladder placement straps 23 may be provided to maintain proper relative positioning of the various bladders when the PFD is in the inflated condition.

The principle and mode of operation of this invention have been explained and illustrated in its preferred embodiment. However, it must be understood that this invention may be practiced otherwise than as specifically explained and illustrated without departing from its spirit or scope.

What is claimed is:

1. A personal flotation device comprising:

a pouch;

a primary bladder that, in a deflated condition, is disposed within the pouch and, in an inflated condition, is generally annular in shape such that it can be supported on a waist of a user;

a secondary bladder that, in a deflated condition, is disposed within the pouch and, in an inflated condition, is generally shaped as a flat panel that extends from the primary bladder such that it can extend across a stomach of the user, the secondary bladder being in fluid communication with the primary bladder; and a tertiary bladder that, in a deflated condition, is disposed within the pouch and, in an inflated condition, is generally shaped as a flat panel that extends from the secondary bladder such that it can extend across a chest of the user, the tertiary bladder being in fluid communication with the secondary bladder.

2. The personal flotation device defined in claim 1 further including an inflation device disposed within the pouch and an activation device including a first end that is connected to the inflation device and a second end that extends exteriorly of the pouch, and wherein the primary bladder is in fluid communication with the inflation device when the activation device is actuated by the user.

3. The personal flotation device defined in claim 1 wherein the secondary bladder includes a first portion adjacent to the primary bladder that is generally annular in shape such that it can be supported on the waist of the user, a second portion that is generally shaped as a flat panel that extends from the primary bladder such that it can extend across the stomach of the user, and a third portion that is generally annular in shape such that it can be supported on an upper torso of the user.

4. The personal flotation device defined in claim 1 wherein the secondary bladder is in fluid communication with the primary bladder through one or more restriction points that cause the secondary bladder to inflate after the primary bladder has been inflated.

5. The personal flotation device defined in claim 4 wherein the tertiary bladder is in fluid communication with the secondary bladder through one or more restriction points that cause the tertiary bladder to inflate after the secondary bladder has been inflated.

6. The personal flotation device defined in claim 1 further including a head support bladder that is in fluid communication with the secondary bladder.

7. The personal flotation device defined in claim 6 wherein the head support bladder is in fluid communication with the secondary bladder through one or more restriction points that cause the head support bladder to inflate after the secondary bladder has been inflated.

8. The personal flotation device defined in claim 3 further including a head support bladder that is in fluid communication with the second portion of the secondary bladder.

9. The personal flotation device defined in claim 8 wherein the head support bladder is in fluid communication with the second portion of the secondary bladder through one or more restriction points that cause the head support bladder to inflate after the secondary bladder has been inflated.

* * * * *